US010334877B2

(12) United States Patent
Qiu

(10) Patent No.: US 10,334,877 B2
(45) Date of Patent: Jul. 2, 2019

(54) ATOMIZING HEAD ASSEMBLY

(71) Applicant: Joyetech (Changzhou) Electronics Co., Ltd., New District Changzhou (CN)

(72) Inventor: Weihua Qiu, Jiangsu (CN)

(73) Assignee: Joyetech (Changzhou) Electronics Co., Ltd., Changzhou, Jiangsu Province (CN)

( * ) Notice: Subject to any disclaimer, the term of this patent is extended or adjusted under 35 U.S.C. 154(b) by 815 days.

(21) Appl. No.: 14/473,712

(22) Filed: Aug. 29, 2014

(65) Prior Publication Data

US 2015/0059787 A1 Mar. 5, 2015

(30) Foreign Application Priority Data

Aug. 31, 2013 (CN) ..... 2013 2 0538951 U

(51) Int. Cl.
*A24F 47/00* (2006.01)
*H05B 3/14* (2006.01)

(52) U.S. Cl.
CPC ..... *A24F 47/008* (2013.01); *H05B 3/14* (2013.01)

(58) Field of Classification Search
CPC ..... A24F 47/0008; A24F 47/008
See application file for complete search history.

(56) References Cited

U.S. PATENT DOCUMENTS 9,301,547 B2 * 4/2016 Liu ..... A24F 47/008
9,986,769 B1 * 6/2018 Liu ..... A24F 47/008
9,999,251 B2 * 6/2018 Liu ..... A24F 47/00
(Continued)

FOREIGN PATENT DOCUMENTS

CN 201878765 U 6/2011
CN 202407083 U 9/2012
(Continued)

OTHER PUBLICATIONS

Espacenet translations of foreign patent document descriptions.*
(Continued)

*Primary Examiner* — Seyed Masoud Malekzadeh
*Assistant Examiner* — Taryn Trace Willett
(74) *Attorney, Agent, or Firm* — Saliwanchik, Lloyd & Eisenschenk

(57) ABSTRACT

The present invention discloses an atomizer head assembly, comprising: an outer tube; an inner tube disposed in the outer tube, having a outer supporter openings formed on a lateral side of wall of the inner tube; a liquid storage chamber formed between the inner tube and the outer tube; a liquid inlet opening formed on a lateral side of wall of the outer tube; and an atomizing member having an end arranged in the one or more outer supporter openings. Moreover, the atomizing head assembly of the present invention comprises a plurality of atomizing members for atomizing liquid electrically connected in parallel and spatially arrange in various configurations, such that the atomizer head assembly can operated with an elevated voltage such that the heat generated per unit time by the atomizer head assembly is increased and the volume of atomized cigarette liquid in the atomizing chamber is increased accordingly.

16 Claims, 7 Drawing Sheets

(56) References Cited

U.S. PATENT DOCUMENTS

2011/0036346 A1* 2/2011 Cohen ..... A61M 15/0065 128/200.14
2011/0303231 A1* 12/2011 Li ..... A24F 47/008 131/329
2012/0285475 A1* 11/2012 Liu ..... A24F 47/008 131/329
2013/0192615 A1 8/2013 Tucker et al.
2013/0192623 A1* 8/2013 Tucker ..... H01C 17/00 131/329
2013/0333711 A1* 12/2013 Liu ..... A24F 47/008 131/329
2014/0182609 A1* 7/2014 Liu ..... A24F 47/008 131/329
2014/0190503 A1* 7/2014 Li ..... A61M 15/06 131/329
2014/0338684 A1* 11/2014 Liu ..... A24F 47/008 131/329
2014/0338686 A1* 11/2014 Plojoux ..... A24F 47/008 131/329
2015/0034104 A1* 2/2015 Zhou ..... A24F 47/008 131/329
2015/0164145 A1* 6/2015 Zhou ..... A24F 47/008 131/329
2015/0164146 A1* 6/2015 Li ..... A24F 47/008 131/329
2015/0189919 A1* 7/2015 Liu ..... A24F 47/008 131/329
2015/0342258 A1* 12/2015 Chen ..... H05B 3/06 131/329
2016/0015081 A1* 1/2016 Liu ..... H05B 3/16 131/329
2016/0015082 A1* 1/2016 Liu ..... A24F 47/008 131/329
2016/0206003 A1* 7/2016 Yamada ..... A24F 47/008
2017/0006922 A1* 1/2017 Wang ..... A24F 47/00

FOREIGN PATENT DOCUMENTS

CN 103584286 A * 2/2014 ..... A24F 47/008
EP 2614731 A1 7/2013
WO WO 2011124033 A1 * 10/2011 ..... A24F 47/008
WO WO 2012065310 A1 * 5/2012 ..... A24F 47/008
WO WO 2015143648 A1 * 10/2015 ..... A24F 47/008
WO WO 2016082178 A1 * 6/2016 ..... H05B 3/40

OTHER PUBLICATIONS

Partial European Search Report dated Mar. 3, 2015 in European Application No. 14182966.3.
European Search Report dated May 31, 2018 in European Application No. 18156521.
Office Action dated Apr. 23, 2019 in European Application No. 18 156 521.9.

* cited by examiner

ATOMIZING HEAD ASSEMBLY

CROSS-REFERENCE TO RELATED APPLICATIONS

This application claims the benefit under 35 U.S.C. § 119 of Chinese Application Number 201320538951.5, filed Aug. 31, 2013, which is hereby incorporated by reference in its entirety.

TECHNICAL FIELD

The present invention generally relates to an electronic cigarette and components thereof, in particular to an atomizing head assembly.

BACKGROUND TECHNOLOGY

The electronic cigarette, now mainly used in some developed countries in Europe and the United States, is primarily used to replace traditional cigarettes. With the continuous improvement of living standards in China, people are also constantly pursuing a higher quality of life, and gradually realize the serious harm of smoking; therefore, quitting smoking gradually becomes a common understanding. Therefore, alternatives such as the electronic cigarette are gradually welcomed by people.

Electronic cigarettes have the same look of cigarettes, and have a similar taste or even better taste than general cigarette tastes. Similar to cigarettes, with electronic cigarettes one can inhale the smoke and experience the taste and feeling. Electronic cigarettes are mainly used to give up smoking and to replace cigarettes. An electronic cigarette is a non-burning, alternative product that has some similar characteristics of regular cigarettes. It can be refreshing, and can provide smokers pleasure and satisfy their habits of many years. But it essentially differs from regular cigarettes, because an electronic cigarette does not burn, has no tar, and does not have the more than 460 kinds of chemical substances which cause respiratory and cardiovascular diseases produced by burning tobaccos, thereby removing the ordinary smoke carcinogens. Electronic cigarettes will not cause passive smoking hazards or environmental pollution.

An atomizer head and a battery rod are two major components of the electronic cigarette. Application No. CN201878765U of a Utility Model Patent discloses an atomizer head 300 (see FIG. 6), wherein the atomizing head 300 includes a main body 330, a suction nozzle seat 310, a heating device 311, a guide tube 322, and a liquid guiding rope 320, wherein one end of the suction nozzle seat 310 provides an atomizing chamber 313, wherein the other end of the suction nozzle seat has a vent hole 314 which communicates with the atomizing chamber 313, and wherein the heating device 311 is fixed in the atomizing chamber 313. One end of the guide tube 322 is inserted into a liquid storage cavity of a liquid storage cartridge (not shown) disposed over the atomizing head 300. The other end of the guide tube 322 connects with the atomizing chamber 313, wherein the heating device 311 is wound around the liquid guiding rope 320. Both ends of the liquid guiding rope 320 are introduced into the guide tube 322.

A connecting assembly of the atomizing head 300 is fixed to an end of a housing (not shown). The connecting assembly includes the main body 330, a contacting conductor 331 connected to the heating device 311 by conductors, and a contacting conductor base 332. The sidewall of the main body of the atomizer is provided with an inlet hole 333 for conducting air which communicates with a cavity. The contacting conductor base 332 is fixed on the other end of the main body of the atomizer exposed to the housing, wherein two contacting conductors 331 are fixed in the contacting conductor base 332, connecting to the power supply positive and negative electrodes, respectively.

The atomizing apparatus of the above-described structures can atomize the cigarette liquid, but also has the following disadvantages:

Firstly, the cigarette liquid is stored in a liquid storage cartridge disposed over the atomizer head such that the cigarette liquid flows downward into the liquid guiding rope. The speeds of the vertical flow of cigarette liquid are not constant and it is difficult to control the flowing speeds to be constant. When the vertical flowing speeds of cigarette liquid are too slow and the heat device is heating at a regular rate, the amount of cigarette liquid contacting the heating device does not meet requirements for a normal amount of cigarette liquid to be sufficiently atomized. As a result, the smoke generated is tasted as a "dry taste" in the mouth of electronic cigarette user. This phenomenon is known as dry combustion and it negatively affects user's enjoyment of smoking of the electronic cigarette.

Secondly, since only one heating device 311 is provided in the atomizing head 300 and the range of voltage of the heating device 311 is limited, the heat generated per unit time by the atomizing head 300 is limited thereby and it is not easy to increase the volume of atomized cigarette liquid in the atomizing chamber.

There remains a need for an improved atomizer head assembly.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

One of the purposes of the present invention is to provide an atomizing head assembly that has a simple structure with an improved liquid flow and airflow to inhibit dry combustion.

The technical solution present in certain embodiments of the subject invention is as follows: an atomizer head assembly comprising: an outer tube; an inner tube disposed in the outer tube, having at least one outer supporter opening formed on a lateral side of a wall of the inner tube; a liquid storage chamber formed between the inner tube and the outer tube; a liquid inlet opening formed on a lateral side of a wall of the outer tube; an atomizing member having an end arranged in the one or more outer supporter openings, wherein the atomizing member comprises a heating element and a liquid guide element. The wall of outer tube of the atomizer head assembly is centrally disposed in a cavity of a liquid storage cartridge where the cigarette liquid is stored. Thus, the cigarette liquid horizontally flows through the liquid inlet opening of the wall of outer tube and enters into the liquid storage chamber formed between the inner tube and the outer tube. When a level of the cigarette liquid in the liquid storage chamber is sufficiently high such that the cigarette liquid contacts the liquid guide element, the liquid guide element absorbs the cigarette liquid and the cigarette liquid gradually permeates the liquid guide element. Since the cigarette liquid horizontally flows through a lateral side of the outer tube into the liquid storage chamber, an improved control of flow volumes and flow rates of inlet liquid can be achieved. As a result, the phenomenon of dry combustion is inhibited and user's enjoyment of smoking of the electronic cigarette is enhanced. Moreover, since the atomizer head assembly is immersed in the liquid storage cartridge, when the heating element of the atomizer head assembly is heating, the atomizer head assembly is cooled by the cigarette liquid stored in the liquid storage cartridge.

Certain embodiments of the present invention provide an atomizer head assembly having an elevated voltage such that the heat generated per unit time by the atomizer head assembly is increased and the volume of liquid atomized in the atomizing chamber of the atomizer head assembly is increased accordingly.

Technical solutions in certain other embodiments of the subject invention are as follows: an atomizer head assembly comprising: an outer tube; an inner tube disposed in the outer tube; a liquid storage chamber formed between the inner tube and the outer tube; at least one liquid inlet opening formed on a lateral side of a wall of the outer tube; and a plurality of atomizing members electrically connected in parallel and spatially arranged in various configurations.

Now, drawings and description of specific exemplary embodiments are combined to fully describe the structures and advantages of the present invention.

DETAILED DISCLOSURE OF THE INVENTION

Figure 1:
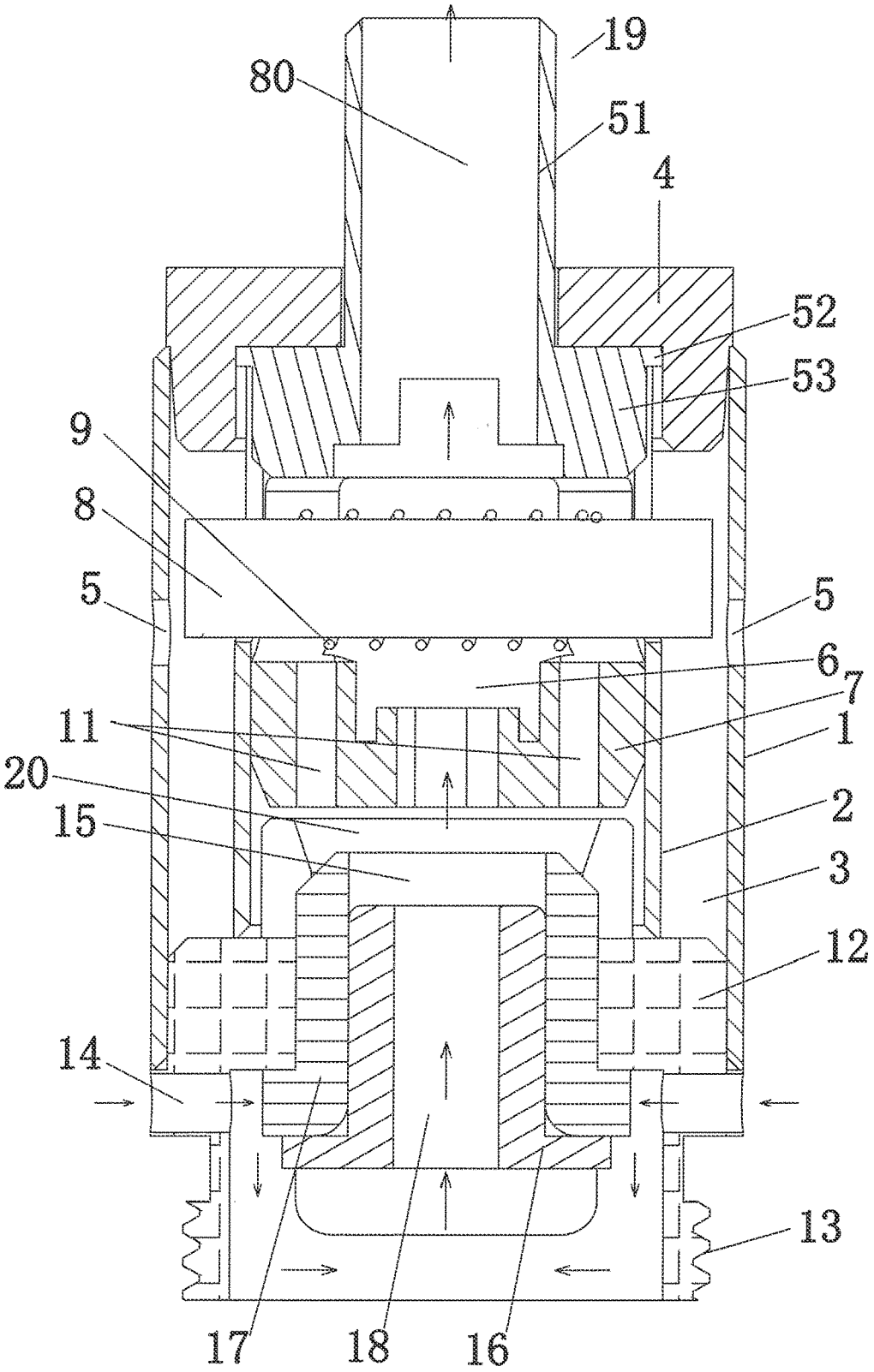
FIG. 1 is a cross-sectional structure diagram of an atomizing head assembly according to an exemplary embodiment of the present invention.

Meanwhile, the terminology used herein is for the purpose of describing particular implementations only and is not intended to be limiting of the present disclosure. The terms "first," "second," and the like, herein do not denote any order, quantity, or importance, but rather are used to distinguish one element from another. For example, a second constituent element may be denoted as a first constituent element without departing from the scope and spirit of the present disclosure, and similarly, a first constituent element may be denoted as a second constituent element.

As used herein, the terms "a" and "an" herein do not denote a limitation of quantity, but rather denote the presence of at least one of the referenced item. That is, as used herein, the singular forms "a," "an," and "the" are intended to include the plural forms as well, unless the context clearly indicates otherwise.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be further understood that the terms "comprises" and/or "comprising," or "includes" and/or "including," when used in this specification specify the presence of stated features, regions, integers, steps, operations, elements, and/or components, but do not preclude the presence or addition of one or more other features, regions, integers, steps, operations, elements, components, and/or groups thereof.

Also, "exemplary" is merely meant to mean an example, rather than the best. If is also to be appreciated that features, layers, and/or elements depicted herein are illustrated with particular dimensions and/or orientations relative to one another for purposes of simplicity and ease of understanding, and that the actual dimensions and/or orientations may differ substantially from that illustrated.

That is, in the drawings, the size and relative sizes of layers, regions, and/or other elements may be exaggerated or reduced for clarity. Like numbers refer to like elements throughout and explanations that duplicate one another will be omitted.

When the terms "on" or "over" are used herein, when referring to layers, regions, patterns, or structures, it is understood that the layer, region, pattern, or structure can be directly on another layer or structure, or intervening layers, regions, patterns, or structures may also be present. When the terms "under" or "below" are used herein, when referring to layers, regions, patterns, or structures, it is understood that the layer, region, pattern, or structure can be directly under the other layer or structure, or intervening layers, regions, patterns, or structures may also be present.

When the term "directly on" is used herein, when referring to layers, regions, patterns, or structures, it is understood that the layer, region, pattern, or structure is directly on another layer or structure, such that no intervening layers, regions, patterns, or structures are present. When the term "direct contact" is used herein, when referring to layers, regions, patterns, or structures in contact with other layers, regions, patterns, or structures, it is understood that the layer, region, pattern or structure is in direct, physical contact with the other layer, region, pattern, or structure, such that no intervening layers, regions, patterns, or structures are present.

When the term "about" is used herein, in conjunction with a numerical value, it is understood that the value can be in a range of 90% of the value to 110% of the value, i.e., the value can be +/−10% of the stated value. For example, "about 1 kg" means from 0.90 kg to 1.1 kg.

Now, the present invention will be further described combining with the drawings and specific embodiments.

Embodiment 1

Figure 2:
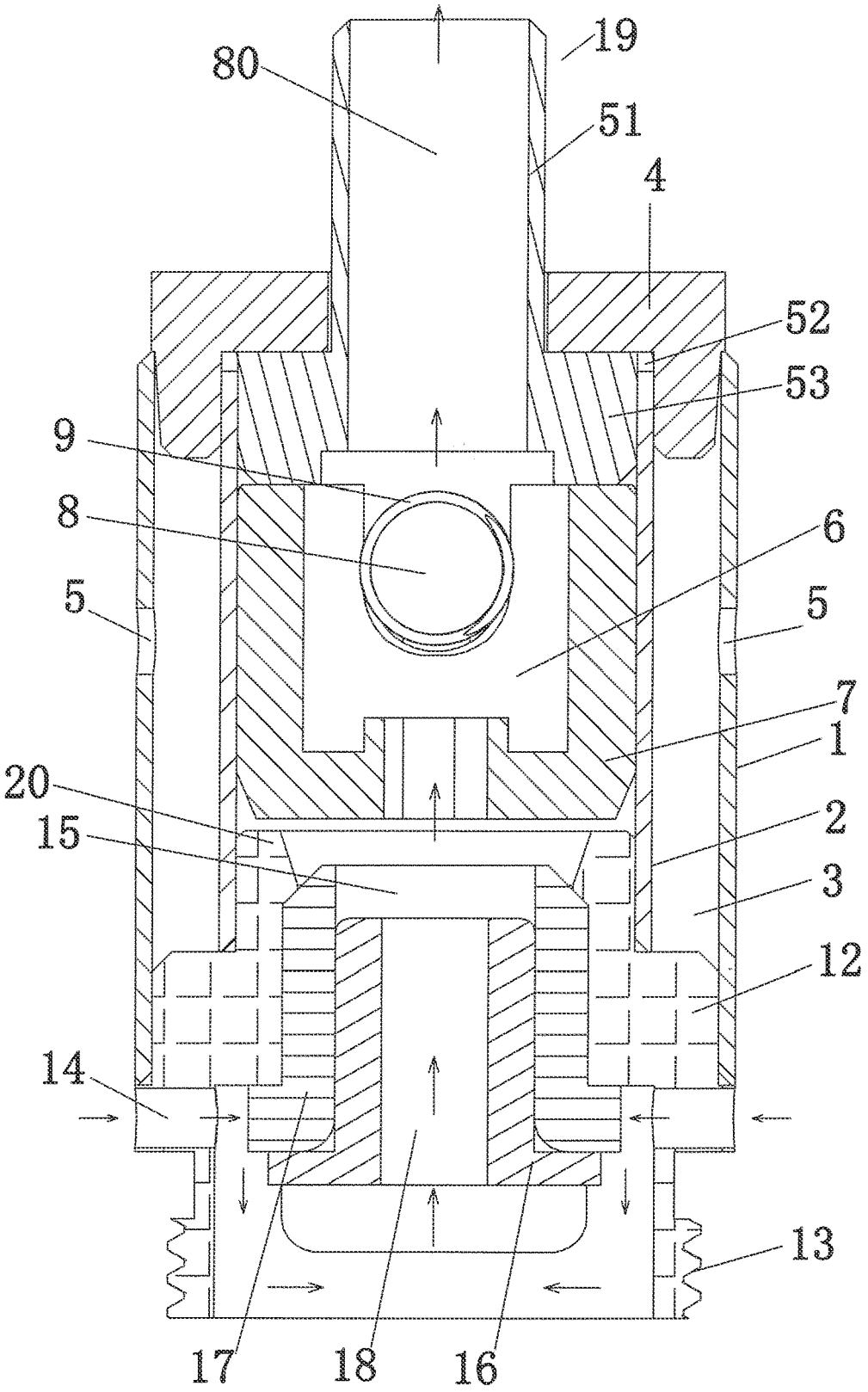
FIG. 2 is a cross-sectional structure diagram of the atomizing head assembly of FIG. 1 rotated 90°.
Figure 3:
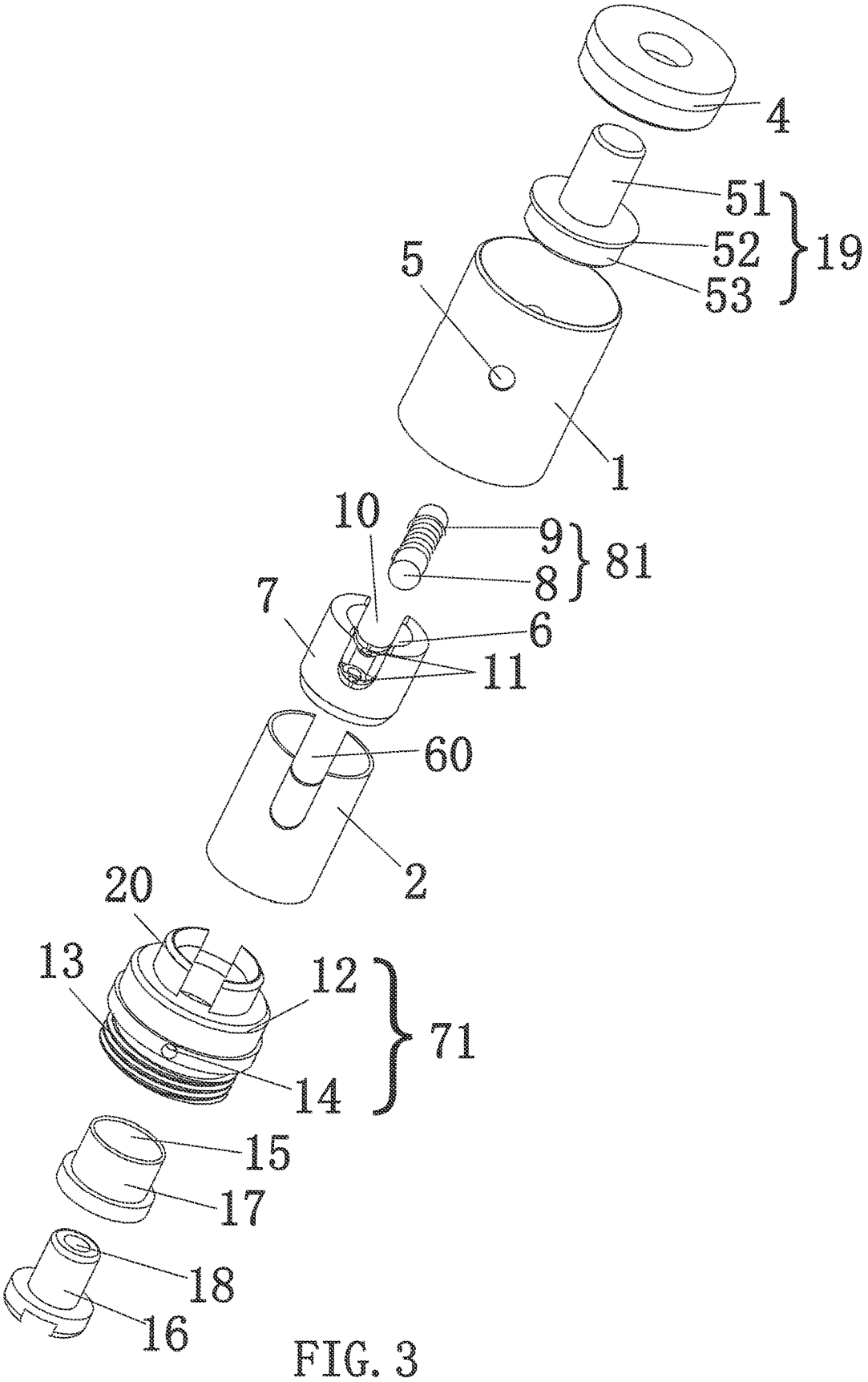
FIG. 3 is an exploded perspective view of an atomizing head assembly according to an exemplary embodiment of the present invention.

Referring to FIGS. 1-3, the atomizer head assembly includes an outer tube 1, a smoke pipe 19, a seal member 4, an inner tube 2, a support unit 7, one or more atomizing members 81, a connecting seat 71, and a conductive member 16.

The atomizer head assembly is disposed inside an atomizer head shell (not shown) which also contains the liquid storage cartridge storing cigarette liquid to be atomized by the atomizer head assembly.

The outer tube 1 is formed with a hollow tube body and is mounted on the connecting seat 71 of the atomizer had assembly. The outer tube 1 may be mounted on a periphery of the connecting seat 71 by press fitting, or may be mounted on the connecting seat 71 by coupling means such as threads, fixing pins, or screws. The inner tube 2 is centrally arranged within the outer tube 1 such that a liquid storage chamber 3 is formed by a wall of inner tube 2 and a wall of outer tube 1 to store liquid, such as cigarette liquid.

Meanwhile, one or more liquid inlet openings 5 are provided on a lateral side of the wall of outer tube 1. The liquid inlet openings 5 may be shaped, sized, and disposed at a location on the lateral side of wall of outer tube 1 to allow a liquid, such as a cigarette liquid stored in the atomizer shell (not show), to flow through the liquid inlet openings 5 into the liquid storage chamber 3. The liquid inlet openings 5 can be through holes of any geometric shape including, but not limited to, circles, ecliptics, ovals, squares, rectangles, or a combination of the above.

The outer tube 1 is made of any suitable material known in the art, for example, stainless steel, though embodiments are not limited thereto.

The connecting seat 71 on which the outer tube 1 is mounted includes a seat neck 20, a seat body 12, and a thread 13. The seat neck 20 has an outer diameter substantially the same as the inner diameter of inner tube 2 such that the inner tube 2 is press fit to the seat neck 20 to be fixed with the connecting seat 71. Meanwhile, the thread 13 is coupled to the atomizer head shell (not shown) to connect the atomizer head assembly with the atomizer head shell.

Moreover, an air intake hole 14 is provided on a lateral wall of the connecting seat 71 through which air is taken from the atomizer head shell (not shown) into a communicating passage 18 centrally formed inside the conductive member 16 and subsequently, flows through an air passage 15 centrally formed inside an insulating part 17, air channels inside the inner tube 2 and the support unit 7, and flows into an atomizing chamber 6 formed inside the inner tube 2 and the support unit 7.

The insulating part 17 is centrally arranged inside the connecting seat 71 by press fitting into the connecting seat 71 to electrically insulate the connecting seat 71 from currents generated by a conductive member 16.

Meanwhile, the conductive member 16 is centrally arranged inside the insulating part 17 by press fitting into the insulating part 17.

The conductive member 16 operating as conductive positive electrode with one end connected with a first lead wire (not shown) of heating elements 9 and with the other end connected with a power source (not shown), such as a battery, external to the atomizer head assembly. The connecting seat 71 operating as conductive negative electrode with one end connected with a second lead wire (not shown) of heating elements 9 of the atomizing members 81 and with the other end connected with a power source (not shown), such as a battery, external to the atomizer head assembly. Thus, current generated by the power source is provided to the heating elements 9 through the conductive member 16, the connecting seat 71, and the lead wires of heating elements 9.

The inner tube 2 arranged inside the outer tube 1 is formed with a hollow tube body and is mounted on the connecting seat 71 by press fitting with the seat neck 20 of the connecting seat 71.

As discussed above, when the inner tube 2 is centrally arranged within the outer tube 1, the liquid storage chamber 3 is formed by a wall of inner tube 2 and a wall of outer tube 1 to store liquid, such as cigarette liquid.

An atomizing chamber 6 is formed with a cylindrical shape inside the inner tube 2. The cigarette liquid contained in an atomizing member 81, which comprises a liquid guide element 8 and a heating element 9 is heated in the atomizing chamber 6 to a sufficiently high temperature by the heating elements 9 to be atomized into aerosols or fine droplets. Air from the bottom of the atomizer head assembly flows over the liquid guide element 8 to entrain the aerosols or fine droplets of cigarette liquid and flow upward through a smoke passage 80 inside the smoke pipe 19 to exit the atomizer head assembly.

The inner tube 2 is made of any suitable material known in the art, for example, stainless steel, though embodiments are not limited thereto.

The inner tube 2 includes one or more outer supporter openings 60 provided on a lateral wall of the inner tube 2.

In one example, the outer supporter openings 60 are formed as notches as shown in FIG. 3 with predetermined depths that are vertically measured from top edges of the notches to the bottom of the notches. The outer supporter openings 60 in forms of notches may take any geometric shape including, but not limited to, U shapes, angular shapes, V shapes, half-circular shapes, half-oval shapes, half-square shapes, half-rectangular shapes, or a combination of the above. As a result, the atomizing members 81 can be securely deposited on the wall of inner tube 2 by mounting ends of the atomizing members 81 in the notches. Thus, an improved liquid permeation in the liquid guide elements 8 of atomizing members 81 and an improved heating effect of the permeating liquid by the heating elements 9 of atomizing members 81 are achieved, resulting in an increased atomization volume in the atomizing chamber 6.

In another example, the outer supporter openings 60 are formed as through holes on the lateral side of the wall of inner tube 2 with predetermined depths that are vertically measured from a top edge of the wall of inner tube 2 to the bottom of the through holes. The outer supporter openings 60 in forms of through holes may take any geometric shape including, but not limited to, circles, ecliptics, ovals, squares, rectangles, or a combination of the above. As a result, the atomizing members 81 can be securely deposited in the wall of inner tube 2 by inserting ends of the atomizing members 81 through the through holes. Thus, an improved liquid permeation in the liquid guide elements 8 of atomizing members 81 and an improved heating effect of the permeating liquid by the heating elements 9 of atomizing members 81 are achieved, resulting in an increased atomization volume in the atomizing chamber 6.

The inner tube 2 may comprise a plurality of outer supporter openings 60 in a notch shape or a through-hole shape where the plurality of outer supporter openings 60 is formed at different depths, allowing a plurality of atomizing members 81 to be mounted in the outer supporter openings 60 with various spatial configurations.

Figure 5A:
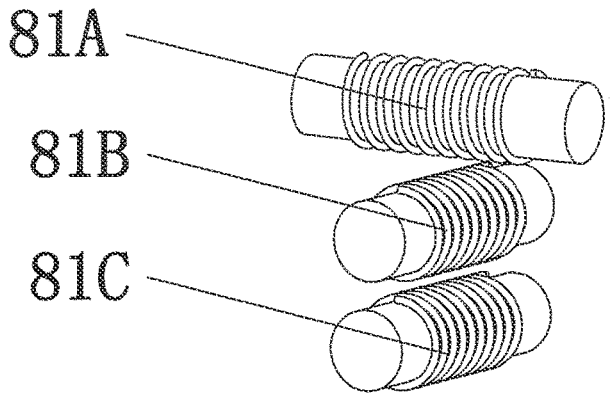
FIG. 5A is a perspective view of the atomizing members of an atomizing head assembly including three atomizing members according to an exemplary embodiment of the present invention.
Figure 5B:
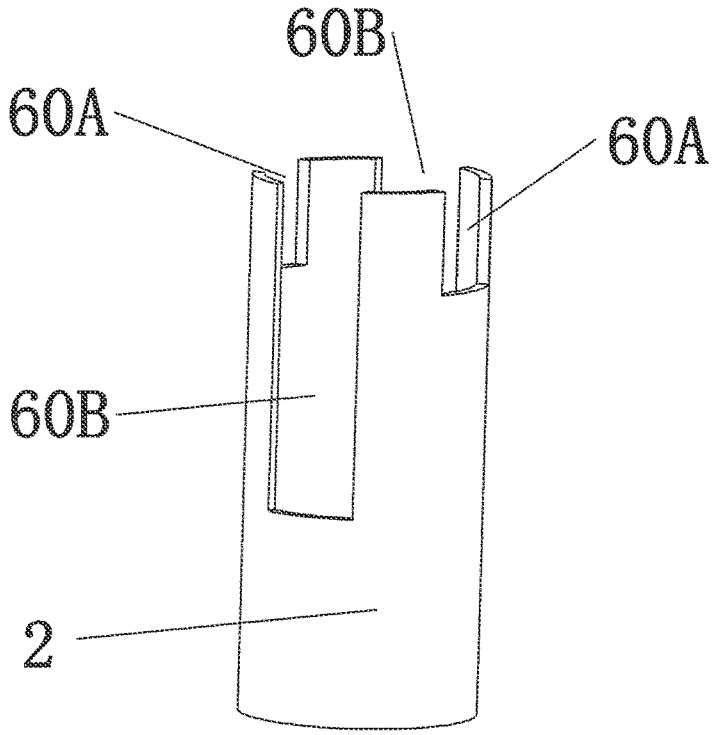
FIG. 5B is a perspective view of an inner tube with deep notches and shallow notches for depositing the three atomizing members of FIG. 6A, according to an exemplary embodiment of the present invention.
Figure 6:
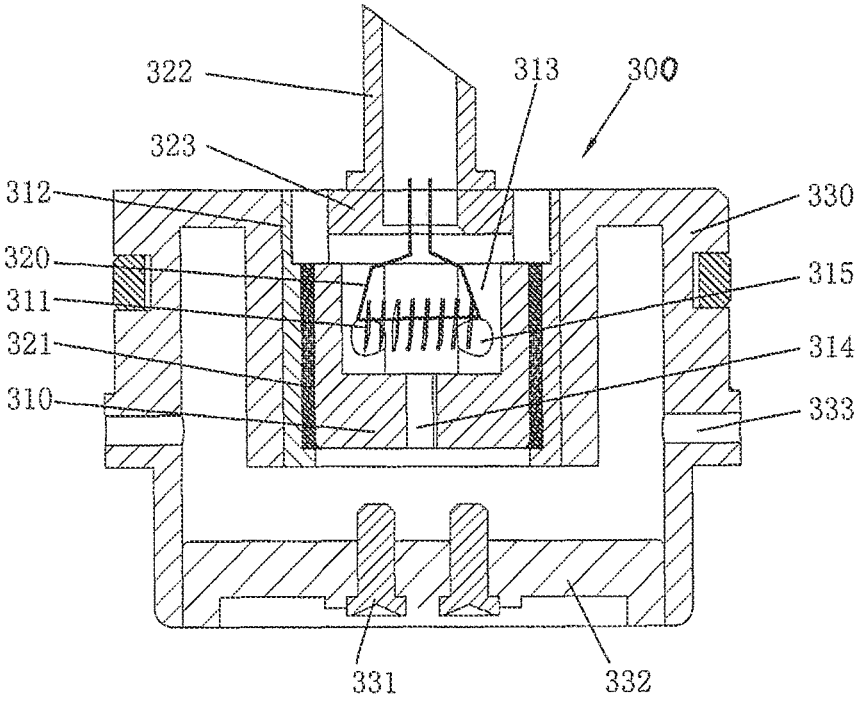
FIG. 6 (Prior Art)
FIG. 6 is cross-sectional structure diagram of an atomizer head assembly according to prior art.

In one example as shown in FIG. 5B, a first pair of outer supporter openings 60A in shapes of rectangular notches are formed in the wall of the inner tube 2, and a second pair of outer supporter openings 60B in shapes of rectangular notches are also formed in the wall of the inner tube 2, wherein the depths of the first pair of outer supporter openings 60A is smaller than the depths of the second pair of outer supporter openings 60B.

Thus, when the atomizing head assembly includes a first atomizing member 81A, a second atomizing member 81B, and a third atomizing member 81C as shown in FIG. 5A, the first atomizing member 81A can be mounted in the first pair of first notches 60A the second atomizing member 81B and the third atomizing member 81C can both be mounted in the second pair of second 60B such that the atomizing member 81B and the atomizing member 81C are both horizontally mounted in a first outer supporter openings 60B of the inner tube 2 and the atomizing member 81A is horizontally mounted in a second outer supporter openings 60A of the inner tube 2, wherein an axis of the first outer supporter openings 60A and an axis of the second outer supporter openings 60B are perpendicular to each other, since the first outer supporter openings 60A and the second outer supporter openings 60A are formed at different depths in the wall of inner tube 2. Thus, the atomizing member 81A mounted in the first outer supporter openings 60A vertically passes over the atomizing members 81B and 81C mounted in the second outer supporter openings 60B and crisscrosses the atomizing members 81B and 81C at an angle of 90°. Though the figures depict and the description presented herein discusses the atomizing member 81A crisscrosses the atomizing members 81B and 81C at an angle of 90°, an atomizer head assembly according to the subject invention can have one or more atomizing members crisscross one or more atomizing member at any angles, including but not limited to 30°, 60°, 120°, 150°, or 180°.

Preferably, the second atomizing member 81B and the third atomizing member 81C are not in touch with each other.

In one exemplary embodiment, when the second atomizing member 81B and the third atomizing member 81C are both mounted in the second pair of second notches 60B, a separation member (not shown) comprising electrically insulating material is disposed between the second atomizing member 81B and the third atomizing member 81C for separating the second atomizing member 81B and the third atomizing member 81C.

Figure 7:
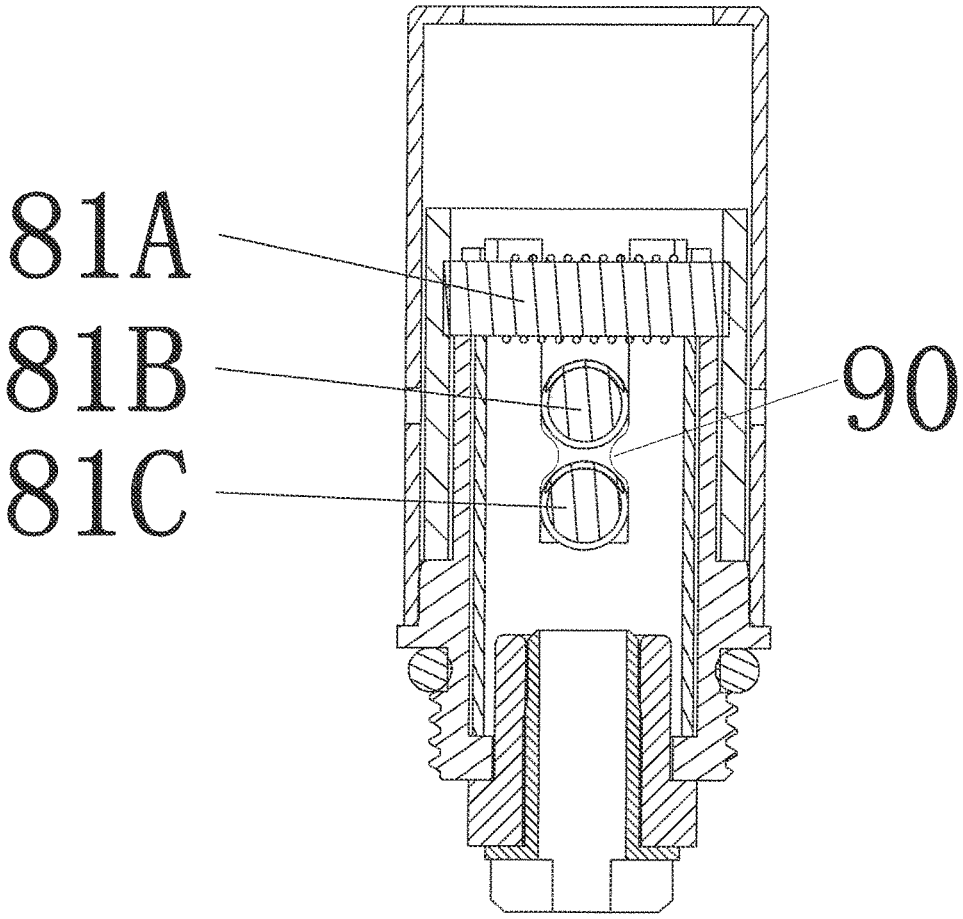
FIG. 7 is a cross-sectional structure diagram of an atomizing head assembly including three atomizing members wherein two of the three atomizing members are disposed in the same outer supporter opening without contacting each other, according to an exemplary embodiment of the present invention.

In another exemplary embodiment as shown in FIG. 7, the second outer supporter openings 60B are sized and shaped to have a narrowed region 90 in the middle. As a result, when the second atomizing member 81B is inserted into an upper portion of the second outer supporter openings 60B above the narrowed region 90 and the third atomizing member 81C is inserted into a lower portion of the second outer supporter openings 608 under the narrowed region 90, the second atomizing member 81B and the third atomizing member 81C can both be mounted in the second pair of second notches 60B without touching each other, even without using a separation member (not shown).

The support unit 7 may be optionally included in the inner tube 2. When the support unit 7 is included in the inner tube 2, the support unit 7 is press fit into the inner tube 2 since the support unit 7 has an outer diameter substantially the same as the inner diameter of inner tube 2.

The support unit 7 is formed with a hollow tube body with one or more inner supporter openings 10 provided on a lateral wall of the support unit 7 for providing a supporting base for the atomizing members 81. Thus, the atomizing members 81 can be mounted in both the inner supporter openings 10 of support unit 7 and the outer supporter openings 60 of inner tube 2.

The inner supporter openings 10 are shaped, sized, and deposited at locations corresponding to the outer supporter openings 60 of the inner tube 2 to allow the atomizing members 81 penetrate both the outer supporter openings 60 and the inner supporter openings 10. In an exemplary embodiment, the inner supporter openings 10 and the outer supporter openings 60 are aligned such that centers of the inner supporter openings 10 and the outer supporter openings 60 are substantially coincide.

In one example, the inner supporter openings 10 are formed as notches as shown in FIG. 3 with predetermined depths that are vertically measured from top edges of the notches to the bottom of the notches. The inner supporter openings 10 in forms of notches may take any geometric shape including, but not limited to, U shapes, angular shapes, V Shapes, half-circular shapes, half-oval shapes, half-square shapes, half-rectangular shapes, or a combination of the above. Thus, the atomizing members 81 can be securely deposited on the wall of the support unit 7 by mounting ends of the atomizing members 81 in the notches.

In another example, the inner supporter openings 10 are formed as through holes on the lateral side of the wall of support unit 7 with predetermined depths that are vertically measured from a top edge of the wall of support unit 7 to the bottom of the through holes. The inner supporter openings 10 in forms of through holes may take any geometric shape including, but not limited to, circles, ecliptics, ovals, squares, rectangles, or a combination of the above. Thus, the atomizing members 81 can be securely deposited in the wall of support unit 7 by inserting ends of the atomizing members 81 through the through holes.

Moreover, the support unit 7 includes two or more through holes 11 vertically pierced through a wall of the support unit 7 such that two lead wires (not shown) of the heating element 9 penetrating through these through holes 11 to connect the heating element 9 with the conductive member 16 and the connecting seat 71, respectively. Thus, electricity is provided from a power source (not shown), such as a battery, external to the atomizer head assembly to the heating element 9 through the conductive member 16, the connecting seat 71, and the lead wires.

The support unit 7 can be made of any suitable material known in the art for retaining heat within the support unit 7, for example, a ceramic material.

The liquid guide element 8 is made of a porous material, including but not limited to, a fibrous material, a ceramic material, or a combination of both. When the cigarette liquid passing through the liquid inlet opening 5 of the outer tube 1 enters into the liquid storage chamber 3 formed between the inner tube 2 and the outer tube 1 and the level of the cigarette liquid in the liquid storage chamber 3 is sufficiently high, the cigarette liquid contacts the liquid guide element 8 and the liquid guide element 8 takes in some of the cigarette liquid. The cigarette liquid thereby subsequently permeates the liquid guide element 8.

The heating element 9 is coupled with the liquid guide element 8 for heating and atomizing the cigarette liquid taken in by the liquid guide element 8. The liquid guide element 8 and the heating element 9 can be coupled in any configurations.

In one example, the heating element 9 is formed in a coil shape winding around the liquid guide element 8 that is formed in a rod shape.

In another example, liquid guide element 8 is formed in a shape of a plurality of liquid guide threads, and heating element 9 is formed in a shape of a plurality of heating wires threads. The plurality of liquid guide threads and the plurality of heating wire threads are mingled and intertwined to form an atomizing member 81 in a shape of a rope.

The heating element 9 is made of a conductive material that comprise a metal including but not limited to, nickel-chromium alloy, iron-chromium alloy, platinum, or a combination of any of these materials.

In an alternative example, the heating element 9 is made of a conductive material that does not comprise a metal including but not limited to, a carbon fiber material.

The heating element 9 is coupled with a lead wire (not shown) through which the heating element 9 is connected with a power source (not shown), such as a battery. Thus, electricity is supplied to the heating element 9 by the power source such that the heating element 9 generates heat to atomize the cigarette liquid.

The atomizing members 81 may comprise one, two, three, or more than three heating elements 9. When more than one heating elements 9 are utilized, the more than one heating elements 9 may be electrically connected with each other in parallel to achieve an increased operating voltage such that the heat generated per unit time by the atomizing members 81 is increased and volume of atomized cigarette liquid generated in the atomizing chamber 6 is increased accordingly.

In particular, since the two or more heating elements 9 of the atomizing members 81 are electrically connected in parallel, an elevated voltage, for example, in a range of 3.3 volts to 6 volts, can be achieved. With an increased voltage, the heat generated per unit time by the heating elements 9 is increased and the volume of aerosol atomized in the atomizing chamber 6 is increased accordingly. Meanwhile, because the two or more heating elements 9 are electrically connected in parallel, to achieve a same heating effect, power required for each heating wire is reduced.

The atomizer head assembly may have one, two, three, or more than three atomizing members 81.

The Atomizer Head Assembly Includes One Atomizing Member:

In a first example as shown in FIG. 1, the atomizer head assembly includes one atomizing member 81 which is horizontally disposed in the atomizing chamber 6 wherein an axis of the atomizing member 81 is parallel to an axis of the atomizing chamber 6.

Figure 4A:
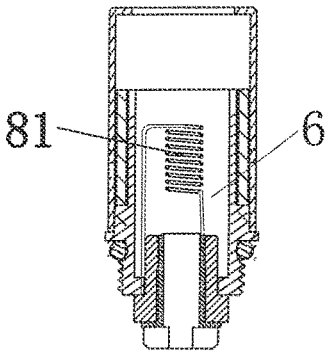
FIG. 4A is a cross-sectional structure diagram of an atomizing head assembly including one atomizing member vertically disposed in the atomizing chamber, according to an exemplary embodiment of the present invention.

In a second example as shown in FIG. 4A, the atomizer head assembly includes one atomizing member 81 which is vertically disposed in the atomizing chamber 6 by fixing two lead wires of the heating element 9 of atomizing member 81 to the conductive member 16 and the connecting seat 71, respectively, wherein an axis of the atomizing member 81 is parallel to an axis of the atomizing chamber 6.

The Atomizer Head Assembly Includes Two Atomizing Members:

In an embodiment the atomizer head assembly includes two atomizing members 81A and 81B disposed in the atomizing chamber 6. The two atomizing members 81A and 81B may be spatially arranged in any of a wide variety of configurations, as shown by examples in FIGS. 4B and 4C.

Figure 4B:
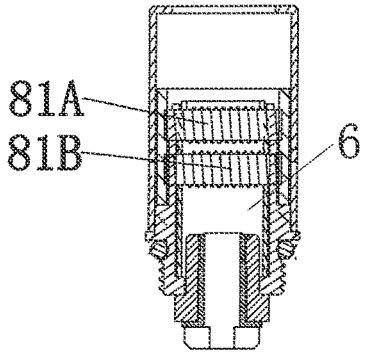
FIG. 4B is a cross-sectional structure diagram of an atomizing head assembly including two atomizing members horizontally disposed in the atomizing chamber wherein the two atomizing members are electrically connected in parallel, according to an exemplary embodiment of the present invention.

Referring to FIG. 4B, the atomizing member 81A and the atomizing member 81B are both horizontally mounted in a same outer supporter opening 60 of the inner tube 2 but at different depths, wherein the atomizing member 81A and the atomizing member 81B are separate from each other. An axis of the atomizing member 81A and an axis of the atomizing member 81B are spatially parallel to each other and are perpendicular to an axis of the atomizing chamber 6.

Figure 4C:
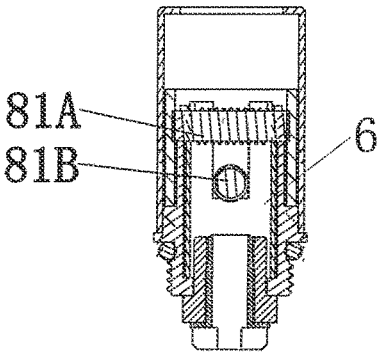
FIG. 4C is a cross-sectional structure diagram of an atomizing head assembly including two atomizing members disposed crisscross in the atomizing chamber wherein the two atomizing members are electrically connected in parallel, according to an exemplary embodiment of the present invention.

In another example as shown in FIG. 4C, the atomizing member 81A and the atomizing to member 81B are horizontally mounted in a first outer supporter openings 60A and in a second outer supporter openings 60B of the inner tube 2, respectively, wherein an axis of the first outer supporter openings 60A and an axis of the second outer supporter openings 60B are perpendicular to each other, and the first outer supporter openings 60A and the second outer supporter openings 60B are formed at different depths in the wall of inner tube 2. Thus, the atomizing member 81A mounted in the first outer supporter openings 60A vertically passes over the atomizing member 81B mounted in the second outer supporter openings 60B and crisscrosses the atomizing member 81B at an angle of 90°. Though the figures depict and the description presented herein discusses the atomizing member 81A crisscrosses the atomizing member 81B at an angle of 90°, an atomizer head assembly according to the subject invention can have one atomizing member crisscross another atomizing member at any angles, including but not limited to 30°, 60°, 120°, 150°, or 180°.

Figure 4D:
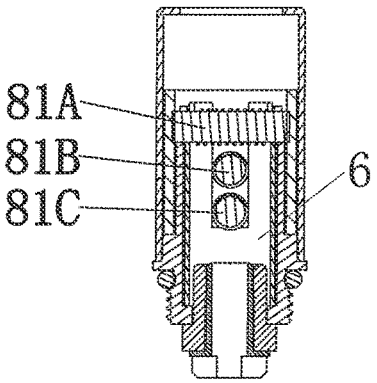
FIG. 4D is a cross-sectional structure diagram of an atomizing head assembly including three atomizing members wherein the first and second of them disposed in parallel and the third disposed crisscross with the first two in the atomizing chamber wherein the three atomizing members are electrically connected in parallel, according to an exemplary embodiment of the present invention.
Figure 4E:
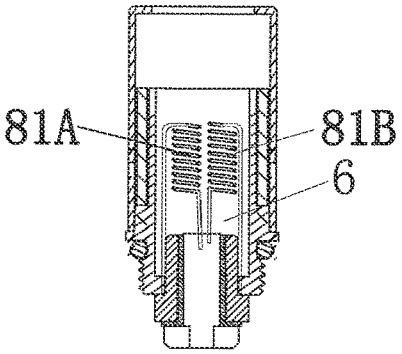
FIG. 4E is a cross-sectional structure diagram of an atomizing head assembly including two atomizing members vertically disposed in the atomizing chamber, according to an exemplary embodiment of the present invention.

In yet another example as shown in FIG. 4E, the atomizing member 81A and the atomizing member 81B are vertically disposed in the atomizing chamber 6 by fixing the two lead wires of each heating element 9 of atomizing member 81A or 81B to the conductive member 16 and the connecting seat 71, respectively, wherein axes of the atomizing members 81A and 81B are both parallel to an axis of the atomizing chamber 6.

The Atomizer Head Assembly Includes Three Atomizing Members:

In yet another example depicted in FIG. 4D, the atomizer head assembly includes three atomizing members 81A, 81B, and 81C.

The atomizing members 81B and 81C are both horizontally mounted in same first outer supporter openings 609 of the inner tube 2 at different depths and are separate from each other. The atomizing member 81A is horizontally mounted in second outer supporter openings 60A of the inner tube 2, wherein an axis of the first outer supporter openings 60A and an axis of the second outer supporter openings 60B are perpendicular to each other, and the first outer supporter openings 60A and the second outer supporter openings 60A are formed at different depths in the wall of inner tube 2. Thus, the atomizing member 81A mounted in the first outer supporter openings 60A vertically passes over the atomizing members 81B and 81C mounted in the second outer supporter openings 60B and crisscrosses the atomizing members 81B and 81C at an angle of 90°. Though the figures depict and the description presented herein discusses the atomizing member 81A crisscrosses the atomizing members 81B and 81C at an angle of 90°, an atomizer head assembly according to the subject invention can have one or more atomizing members crisscross one or more atomizing member at any angles, including, but not limited to 30°, 60°, 120°, 150°, or 180°.

Though the figures depict and the description presented herein discusses two or three atomizing members electrically connected in parallel and spatially arranged in various configurations, an atomizer head assembly according to the subject invention can have four or more atomizing members electrically connected in parallel and spatially arranged in various configurations.

Referring back to FIGS. 1 and 2, when the heating elements 9 of the atomizing members 81B heat the cigarette liquid absorbed in the liquid guide element 8 to a sufficiently high temperature in the atomizing chamber 6, the cigarette liquid is atomized into aerosols or fine droplets. Air entering from air intake hole 14 of the connecting seat 71 and flowing upward to the atomizing chamber 6 entrains the aerosols or fine droplets of cigarette liquid to flow up through a smoke passage 80 inside the smoke pipe 19.

The smoke pipe 19 is centrally disposed inside the inner tube 2 and includes a pipe base 53 at the bottom, an outlet pipe 51 at the top, and a sealing disc 52 in the middle connecting the pipe base 53 and the outlet pipe 51. The hollow interiors of the pipe base 53, the outlet pipe 51, and the sealing disc 52 integrally form the smoke passage 80 inside the smoke pipe 19 such that the atomized cigarette liquid generated inside the atomizing chamber 6 is entrained by the upflowing air to flow upward and exit the atomizer head assembly through the smoke passage 80.

Moreover, the pipe base 53 of the smoke pipe 19 has an outer diameter substantially the same as the inner diameter of inner tube 2, such that the smoke pipe 19 is fixedly inserted into the inner tube 2.

Furthermore, the sealing disc 52 of the smoke pipe 19 has an outer diameter sufficiently larger than the outer diameter of the inner tube 2 such that the smoke pipe 19 is fixedly inserted into the inner tube 2 by pressing fit the pipe base 53 into the inner tube 2 and mounting the outer circumferential portion of sealing disc 52 on a top surface of the wall of inner tube 2.

Thus, the sealing disc 52 is supported by the wall of inner tube 2 and seals the clearance between the pipe base 53 and the wall of inner tube 2 from the top. Since the sealing disc 52 and the pipe base 53 together seal the atomizing chamber 6 of the support unit 7 at the top, air flowing into the atomizing chamber 6 or atomized cigarette liquid generated within atomizing chamber 6 can only exit the atomizer head assembly through the smoke passage 80 of the smoke pipe 19. As a result, a leak of the air or the atomized cigarette liquid out of the atomizing chamber 6 is inhibited.

The liquid storage chamber 3 formed between the inner tube 2 and the outer tube 1 is also sealed from the top by the seal member 4 to inhibit cigarette liquid in the liquid storage chamber 3 from leaking out of the atomizer head assembly.

The seal member 4 has a circular ring structure with an opening in the center. The outlet pipe 51 of smoke pipe 19 extends through the central opening of the seal member 4. The seal member 4 is press fit between the inner tube 1 and the outer tube 2 to seal the liquid storage chamber 3. Moreover, the seal member 4 has an outer diameter substantially the same as the inner diameter of outer tube 1 and an inner diameter substantially the same as the outer diameter of inner tube 2.

The seal member 4 is made with any elastic materials including, but not limited to, silica gel, rubber, plastic, or elastic alloy, or a combination of any of these elastic materials. Since the seal member 4 is made with elastic materials and since the seal member 4 has an outer diameter substantially the same as the inner diameter of outer tube 1 and an inner diameter substantially the same as the outer diameter of inner tube 2, when the seal member 4 is press fit between the outer tube 1 and inner tube 2, the liquid storage chamber 3 formed between the inner tube 2 and the outer tube 1 is sealed from the top by the seal member 4 to inhibit cigarette liquid in the liquid storage chamber 3 from leaking out of the atomizer head assembly.

Referring to FIGS. 1 and 2, the arrows in FIGS. 1 and 2 indicate directions that air enters into and flows through the atomizer head assembly, and the atomized cigarette liquid entrained by the air and discharged out of the atomizer head assembly.

The cigarette liquid horizontally flows through the liquid inlet opening 5 of the wall of outer tube 1 and enters into the liquid storage chamber 3 formed between the inner tube 2 and the outer tube 1. When the level of the cigarette liquid in the liquid storage chamber 3 is sufficiently high such that the cigarette liquid contacts the liquid guide element 8, the liquid guide element 8 absorbs the cigarette liquid and the cigarette liquid gradually permeates the liquid guide element 8. Since the cigarette liquid horizontally flows through a lateral side of the outer tube 1 into the liquid storage chamber 3, an improved control of inlet liquid flow volume and flow rate can be achieved.

Air enters the connecting seat 71 through the air intake hole 14 on the wall of the connecting seat 71, passes through the communicating hole 18 and then through hole 15, and enters the atomizing chamber 6 to flow over the liquid guide element 8 which absorbs and permeates with the cigarette liquid.

The cigarette liquid contained in the heating element 9 is heated in the atomizing chamber 6 to a sufficiently high temperature by the heating elements 9 to be atomized into aerosols or fine droplets. Air flowing over the liquid guide element 8 entrains the aerosols or fine droplets of cigarette liquid and flows up through the smoke passage 80 inside the smoke pipe 19 to exit the atomizer head assembly, Alternative Embodiment Referring to FIGS. 1 and 2, an atomizing head comprises an outer tube 1, an inner tube 2 placed in the outer tube 1, and a sealed liquid storage chamber 3 formed between the outer wall of the inner tube 2 and the inner wall of the outer tube 1 by providing a seal member 4, such as a plug of silica gel provided between the inner tube 2 and the outer tube 1, to inhibit the cigarette liquid from leaking out from the liquid storage chamber 3 formed between the inner tube 2 and the outer tube 1. A liquid inlet opening 5 of the outer tube 1 that communicates with the liquid storage chamber 3, such that the external cigarette liquid can get into the liquid storage chamber 3. A support unit 7 having an atomizing chamber 6 is provided in the inner tube 2, wherein the support unit 7 is made of a ceramic material, and a liquid guide element 8 made of a fibrous material and wound by a metal heating element 9 is provided in the atomizing chamber 6, with the end of the liquid guide element 8 sequentially passing through the inner supporter openings 10 of the support unit 7 and the outer supporter openings 60 on the inner tube 2, and containing the cigarette liquid stored in the liquid storage chamber 3.

In an example, the inner supporter openings 10 on the support unit 7 and the outer supporter openings 60 on the inner tube 2 are U-shaped slots.

The support unit 7 is provided with a plurality of through holes 11 communicating through the atomizing chamber 6. The support unit 7 is assembled in the inner tube 2 so as to form a fixation.

A connecting seat 71 is provided under the outer tube 1, forming a supporting limit for one end of the inner tube 2 and the support unit 7 of the inner tube 2. The support unit 7 and the inner tube 2 are limited in the outer tube via the connecting seat 71. The connecting seat 71 is provided with a thread 13 for connecting to other parts. The connecting seat 71 is also provided with an air intake hole 14 communicating with a through-hole of the support unit 7. A through-hole 15 is centrally provided in the connecting seat 71.

A conductive member 16 is arranged in the through-hole 15. An insulating part 17 is provided between the conductive member 16 and the connecting seat 71, wherein the conductive member 16 is provided with a communicating hole 18 that communicates the air taken in through the air intake hole 14 to the through-hole of the support unit 7.

The other end of the inner tube 2 is connected to a smoke pipe 19 that communicates with the atomizing chamber 6. The smoke pipe 19 extends through seal member 4 to outside of the outer tube 1.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

It should be understood that the examples and embodiments described herein are for illustrative purposes only and that various modifications or changes in light thereof will be suggested to persons skilled in the art and are to be included within the spirit and purview of this application.

I claim:

1. An atomizer head assembly, comprising:

an outer tube;

an inner tube disposed inside the outer tube, having air channels for air to pass through;

a liquid storage chamber formed between an outer surface of the inner tube and an inner surface of the outer tube;

one or more through holes formed on a lateral side of the outer tube, communicating with the liquid storage chamber;

an atomizing chamber formed inside the inner tube;

one or more first openings formed on a lateral side of the inner tube, communicating with the liquid storage chamber;

a liquid guide element disposed inside the atomizing chamber; and a holder disposed inside the inner tube, the holder including a plurality of through holes vertically pierced through a wall of the holder such that a plurality of wires of a heating element penetrating through the through holes connects the heating element with a conductive member and a connecting seat, respectively, the connecting seat being provided under the outer tube and supporting the outer tube, wherein the connecting seat has a seat neck protruding upwardly from a top surface of the connecting seat, wherein the seat neck comprises two arc-shaped portions spaced part from each other, and the seat neck is configured to have an outer diameter substantially same as an inner diameter of the inner tube such that the inner tube is press fit onto the seat neck to be fixed to the connecting seat;

wherein the holder comprises one or more second openings formed on a lateral side of the holder, and wherein the one or more second openings have shapes, sizes, and locations on the holder corresponding to shapes, sizes, and locations of the one or more first openings formed on the inner tube; and wherein the liquid guide element is mounted in the one or more first openings of the inner tube and is also mounted in the one or more second openings of the holder such that ends of the liquid guide element are in fluid communication with the liquid storage chamber.

2. The atomizer head assembly of claim 1, wherein the one or more first openings are formed with a notch shape comprising any one of following: a U shape, an angular shape, a V shape, a half-circular shape, a half-oval shape, a half-square shape, or a half-rectangular shape.

3. The atomizer head assembly of claim 1, wherein the one or more first openings are formed with a through-hole shape comprising any one of following: a circle, an eclipse, an oval, a square, or a rectangle.

4. The atomizer head assembly of claim 1, wherein there are at least two first openings, and wherein at least one of the at least two first openings is formed at a location different from a location of the remainder of the at least two first openings on the lateral side of the inner tube.

5. The atomizer head assembly of claim 1, further comprising a smoke pipe arranged at a top portion of the inner tube, communicating with the atomizing chamber.

6. The atomizer head assembly of claim 1, further comprising a seal member arranged at a top portion of the liquid storage chamber, sealing the top portion of the liquid storage chamber.

7. The atomizer head assembly of claim 1, wherein the holder is formed of a heat retaining material including a ceramic material.

8. An atomizer head assembly, comprising:

an atomizing tube having an atomizing chamber, a holder disposed inside the atomizing tube, the holder including a plurality of through holes vertically pierced through a wall of the holder such that a plurality of wires of a heating element penetrating through the through holes connects the heating element with a conductive member and a connecting seat, respectively, the connecting seat being provided under an outer tube and supporting the outer tube wherein the connecting seat has a seat neck protruding upwardly from a top surface of the connecting seat, the seat neck comprises two arc-shaped portions spaced part from each other, and the seat neck is configured to have an outer diameter substantially same as an inner diameter of an inner tube such that the inner tube is press fit onto the seat neck to be fixed to the connecting seat, and the inner tube having air channels for air to pass through; and two or more atomizing members for atomizing liquid disposed inside the atomizing chamber;

wherein the two or more atomizing members are electrically connected in parallel; and wherein the two or more atomizing members each is mounted in openings of lateral walls of both the atomizing tube and the holder.

9. The atomizer head assembly of claim 8, wherein the two or more atomizing members are formed with a shape comprising any of following: a rod, a rope, a thread, or a bar.

10. The atomizer head assembly of claim 8, wherein axes of the two or more atomizing members are spatially arranged to be perpendicular to an axis of the atomizing chamber.

11. The atomizer head assembly of claim 10, wherein an axis of at least one of the two or more atomizing members is spatially arranged to be perpendicular to axes of the remainder of the two or more atomizing members.

12. The atomizer head assembly of claim 10, wherein an axis of at least one of the two or more atomizing members is spatially inclined at an angle with respect to axes of remainder of the two or more atomizing members.

13. The atomizer head assembly of claim 8, wherein axes of the two or more atomizing members are spatially arranged to be in parallel to an axis of the atomizing chamber.

14. The atomizer head assembly of claim 8, wherein at least one of the two or more atomizing members is spatially arranged to be perpendicular to an axis of the atomizing chamber, and remainder of the two or more atomizing members are spatially arranged to be in parallel to the axis of the atomizing chamber.

15. The atomizer head assembly of claim 8, wherein an axis of at least one of the two or more atomizing members is inclined at an angle with respect to an axis of the atomizing chamber.

16. The atomizer head assembly of claim 8, wherein the two or more atomizing members each comprises a heating element made of a nonmetallic conductive material.

* * * * *